United States Patent [19]

Yabuuchi

[11] Patent Number: 4,952,917

[45] Date of Patent: Aug. 28, 1990

[54] DISPLAY SYSTEM WITH LUMINANCE CALCULATION

[75] Inventor: Shigeru Yabuuchi, Tokyo, Japan

[73] Assignee: Hitachi, Ltd., Tokyo, Japan

[21] Appl. No.: 143,956

[22] Filed: Jan. 14, 1988

[30] Foreign Application Priority Data

Jan. 19, 1987 [JP] Japan ..... 62-8029

[51] Int. Cl.[5] ..... G09G 5/00

[52] U.S. Cl. ..... 340/703; 358/168

[58] Field of Search ..... 340/701, 703; 358/31, 358/39, 161, 168, 219

[56] References Cited

U.S. PATENT DOCUMENTS

| | | | |
|---|---|---|---|
| 3,928,867 | 12/1975 | Lynch | 358/39 |
| 4,090,216 | 5/1978 | Constable | 358/39 |
| 4,386,345 | 5/1983 | Narveson et al. | 340/703 |
| 4,799,106 | 1/1989 | Moore et al. | 358/168 |

*Primary Examiner*—Alvin Oberley
*Assistant Examiner*—Richard Hjerpe
*Attorney, Agent, or Firm*—Antonelli, Terry, Stout & Kraus

[57] ABSTRACT

A display system calculates the value of luminance of a screen of a display unit for each display frame and dynamically controls the luminance of the display screen on the basis of the calculated luminance value while taking the surrounding brightness, thereby providing a display appearance easiest to see.

11 Claims, 5 Drawing Sheets

DISPLAY SYSTEM WITH LUMINANCE CALCULATION

BACKGROUND OF THE INVENTION

The present invention relates to a display system used in the terminal of a digital computer or for display of graphs.

In a device using a display unit, it is necessary to provide a display screen easy to see for the purpose of reducing the user's fatigue. Therefore, the conventional display system is equipped with an adjuster capable of changing the luminance (or brightness) of the display screen or a device for detecting the brightness of the interior of a room by a photo sensor to control the luminance of the display screen in accordance with the brightness of the room.

However, such conventional display systems have a problem that a higher-degree and fine control of the display screen luminance cannot be effected and hence the display screen may exhibit a glittering appearance difficult to see in dependence on the contents displayed on the screen, thereby increasing the user's fatigue.

SUMMARY OF THE INVENTION

An object of the present invention is to provide a display system capable of dynamically controlling the luminance of the display screen in accordance with the contents to be displayed on the screen, thereby always providing a display appearance of the display screen easy to see.

To that end, in the display system according to the present invention, the luminance of each of the picture elements of an image to be displayed on the screen is read in synchronism with a raster scan and the total sum of the values of luminance of the respective picture elements is determined for use as a value of the luminance of the display screen. This process is carried out for each change of the image on the display screen or each refresh cycle. The actual luminance of the display screen is dynamically controlled on the basis of the thus determined luminance of the display screen while taking the surrounding or ambient luminance into consideration, thereby providing a display appearance of the display screen easiest to see in accordance with the displayed contents on the screen.

More especially, when the surrounding luminance changes, a relationship between the luminance of the display screen and the visual acuity exhibits such a characteristic as shown in FIG. 2 (see NIKKEI ELECTRONICS, No. 333, pp. 158–177, Jan. 2, 1984). In FIG. 2, the abscissa represents the logarithmic ratio of the surrounding luminance $B_S$ to the average luminance $B_D$, of the display screen and the ordinate represents the relative sensitivity of contrast discrimination when it is 1.0 in the case of $B_D=B_S$. In the range where the ratio $B_S/B_D$ of the surrounding luminance $B_S$ to the display screen luminance $B_S$ is 0.1 to 3.0, little influence is given on the visual acuity and the contrast discriminative activity. However, in regions departed from this range, the visual acuity shows a tendency to decrease, thereby making the display appearance difficult to see. This tendency is remarkable, especially as the surrounding becomes brigther as in the case of $B_S>B_D$. Therefore, in the case where a large amount of data (characters, figures and/or picture images) are to be displayed, the luminance of the entire screen, which otherwise becomes higher, is lowered in accordance with FIG. 2 while taking the surrounding condition into consideration. In contrast, when the amount of data to be displayed is less, the luminance of the entire screen, which otherwise becomes lower, is enhanced so as to conform to the condition of FIG. 2. Such a luminance control can migrate a stimulus to the user's eyes, thereby making the user hard to fatigue.

DESCRIPTION OF THE PREFERRED EMBODIMENTS

An embodiment of the present invention will now be explained by virtue of FIG. 1.

Figure 1:
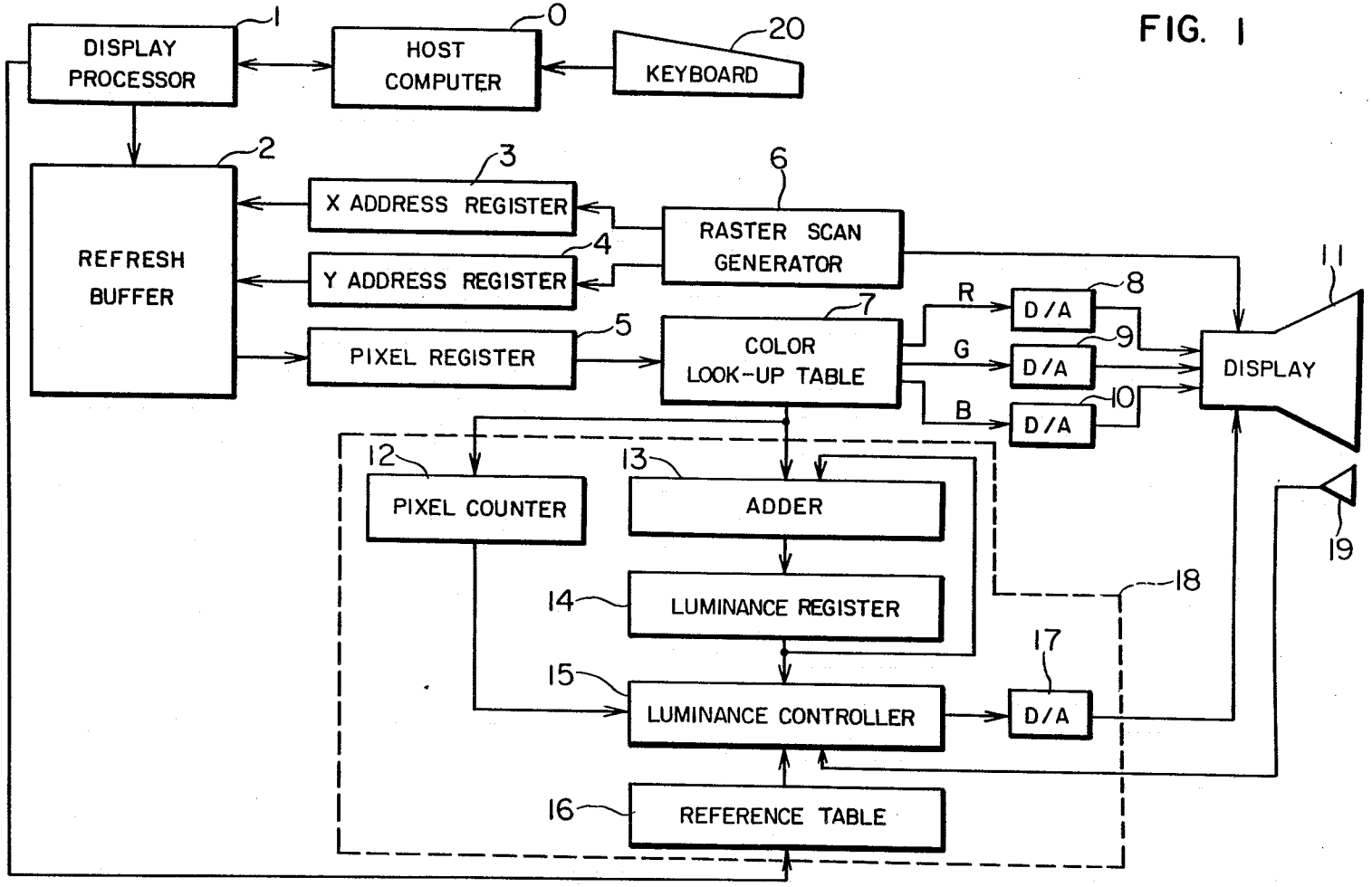
FIG. 1 is a circuit diagram showing a display system according to an embodiment of the present invention.
Figure 3:
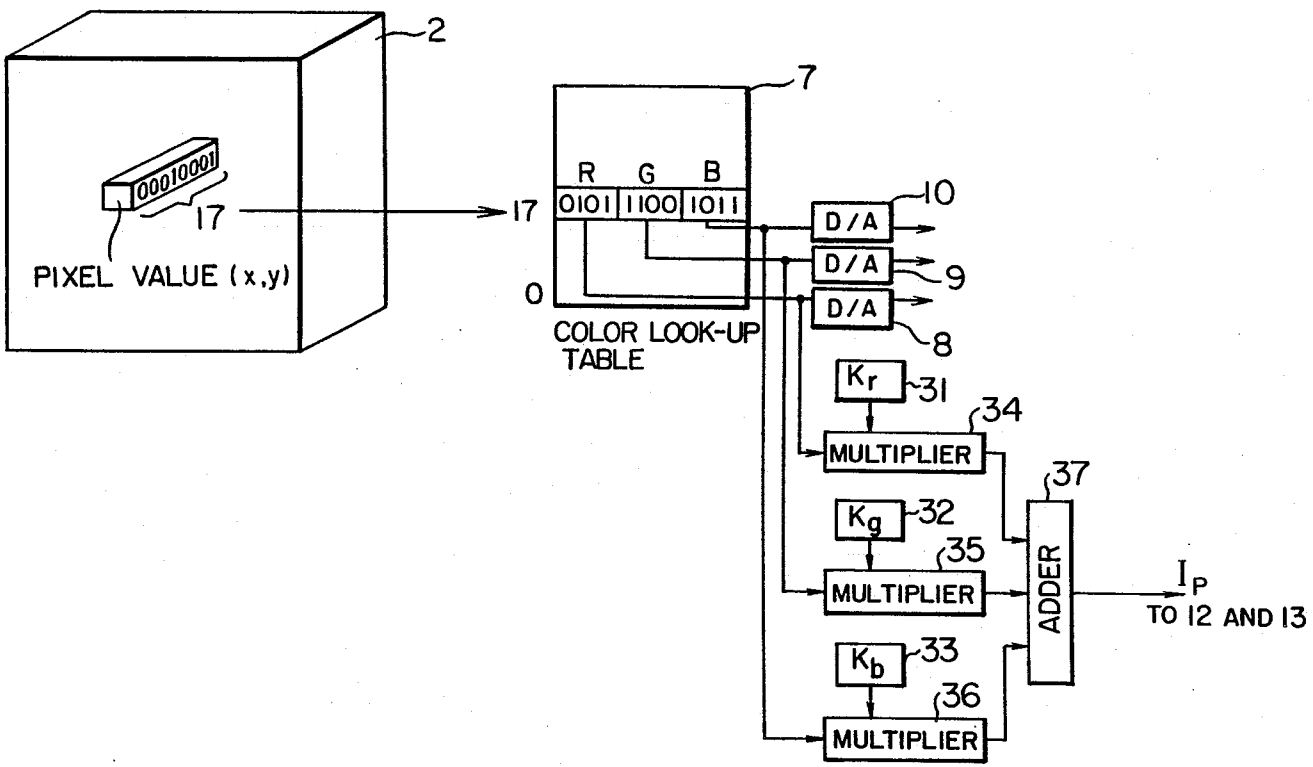
FIG. 3 is a view showing an example of a table look-up scheme.

Referring to FIG. 1, a display processor 1 develops an image to be displayed on the screen of a display unit 11 into respective display data (e.g. codes representative of colors to be displayed) for picture elements or pixels on the display screen. The developed display data are stored in a refresh buffer 2. The refresh buffer 2 has the number of addresses corresponding to the number of pixels of an image to be displayed on the display screen. The display data for each pixel is different in accordance with the performance of the display unit 11. In the case of a binary (black and white) display, the display (white) or non-display (black) is represented by one bit. In the case of a full-color display such as image display, each of R, G and B being primary colors is represented by several bits. The present embodiments employs a table look-up scheme using a color look-up table 7. In this scheme, as shown in FIG. 3, colors to be displayed are limited to several kinds with primaries of each of those colors registered in the table 7 and the addresses of the table 7 are written in the refresh buffer 2. Such a technique is described by James D. Foley et al, "Fundamentals of Interactive Computer Graphics" published by Addison-Wesley Publishing Company on 1982.

Figure 4:
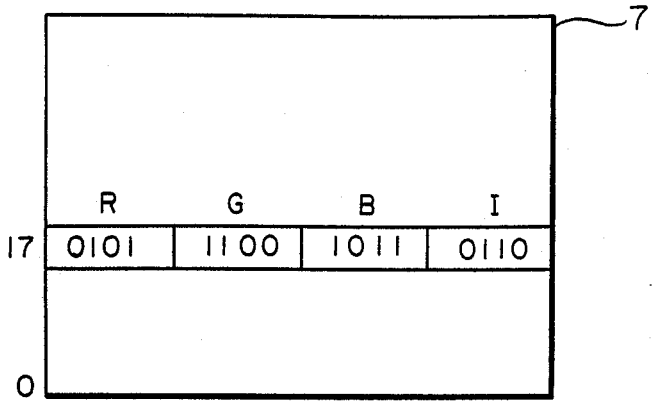
FIG. 4 shows the contents of a color look-up table used in the present invention.

In the present invention, luminance data determined by the primaries of each color is newly registered in the color look-up table 7 in addition to the respective components or quantities of the primaries, as shown in FIG. 4. The display unit 11, which is a raster scan type of color display unit, is applied with (1) an X-/Y-axis deflection signal, (2) chrominance signals of R, G and B, and (3) a luminance control signal.

A raster scan generator 6 controls those signals to display on the display unit 11 an image which corresponds to the display data written in the refresh buffer 2. More particularly, the raster scan generator 6 generates a deflection signal effecting a raster scan operation which includes deflecting a beam of the display unit 11 in the X-axis direction of the display screen, thereafter displacing the coordinate value slightly to the Y-axis direction and then moving or deflecting the beam in the X-axis direction again. This deflection signal is applied to the display unit 11. At the same time, chrominance signals are generated in synchronism with the raster scan and applied to the display unit 11. In this manner, the image corresponding to the display data is displayed on the screen of the display unit 11.

The chrominance signals are generated as follows. First, display data for each pixel of an image to be displayed is read from the refresh buffer 2 at its address designated by X and Y address registers 3 and 4 and is stored in a pixel register 5. Primary color (or chrominance) data and luminance data corresponding to the display data are read from the color look-up table 7 at its address indicated by the pixel register 5. The primary color data are supplied to the display unit 11 after D/A conversion by D/A converters 8, 9 and 10.

The luminance data read from the color look-up table 7 is applied to a luminance control section 18 provided according to the present invention. The luminance control section 18 includes a part which calculates the luminance of the display screen and a part which controls the luminance of the display screen on the basis of the calculated luminance. More particularly, the calculating part is constructed by a pixel counter 12, an adder 13 and a luminance (or intensity) register 14 while the controlling part is constructed by a luminance (or intensity) controller 15, a reference table 16 and a D/A converter 17. The raster scan generator 6 clears the contents of the luminance register 14 and the contents of the pixel counter 12 when the image on the display screen is refreshed. Each time the luminance data for each pixel is read from the color look-up table 7, the adder 13 adds it to the contents of the luminance register 14 and the result of addition is stored in the luminance register 14 again. This operation is performed over one image to be displayed on the entire display screen, thereby determining the luminance of the entire display screen.

In the case where the display unit 11 is of a binary (black and white) display type, the pixel counter 12 counts the number of pixels which have the values of luminance data not equal to zero, that is, pixels which are not black, thereby determining the number of pixels which are to be lightened on the entire display screen.

Figure 2:
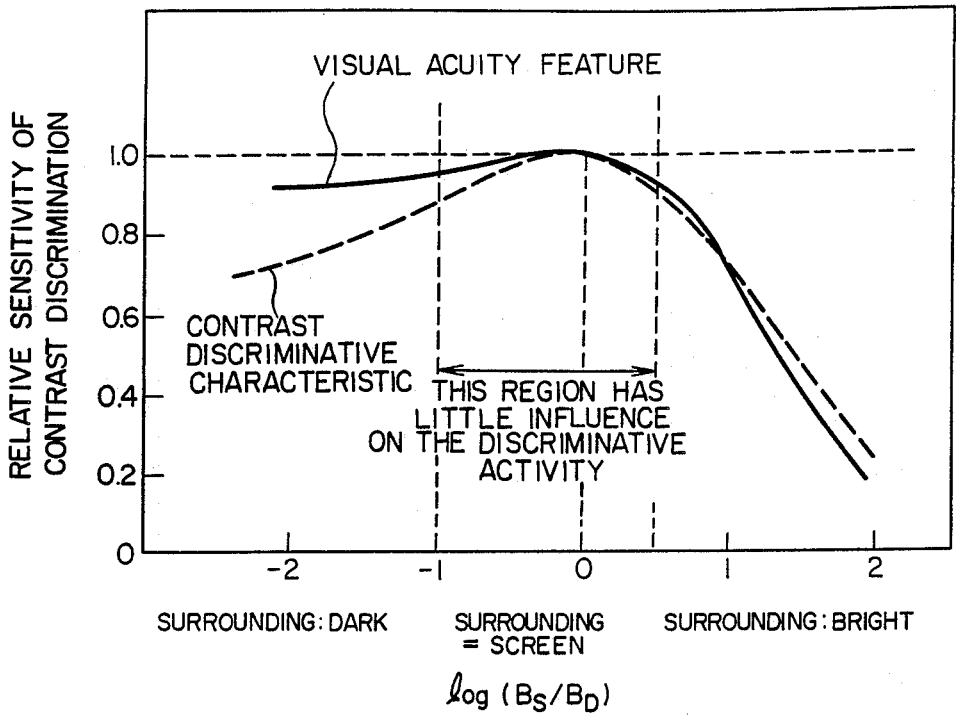
FIG. 2 is a view showing the relation of the visual acuity and the contrast discriminative activity with the display screen luminance and the surrounding luminance.

The luminance controller 15 reads out data indicative of a control condition of luminance from the reference table 16 during the refreshing period. Referring to this data together with the contents of the pixel counter 12, the contents of the luminance register 14 and the value of a photo sensor 19 which detects the brightness or luminance of the interior of a room, the luminance controller 15 produces a luminance control signal which makes the brightness of the display screen optimum, as shown in FIG. 2. The luminance control signal is D/A converted by the D/A converter 17 and applied to the display unit 11. The luminance control condition provided by the reference table 16 may be designated through a host computer 0 and the display processor 1 from a keyboard 20 in accordance with the user's taste or desire.

In the case where color data (R, G, B) for each pixel is directly stored in the refresh buffer 2, means (constituted by, for example, coefficients 31–33, multipliers 34–36 and adder 37) for calculating the luminance $I_p$ for the pixel p in accordance with the equation $$I_p = K_r \cdot G_p + K_b \cdot B_p \quad (1)$$

is provided between the color look-up table 7 and the connection point of adder 13 and pixel counter 12, as shown in FIG. 3. In the equation (1), $R_p$, $G_p$ and $B_p$ are color data for the pixel p and $K_r$, $K_g$ and $K_b$ are coefficients.

Figure 5:
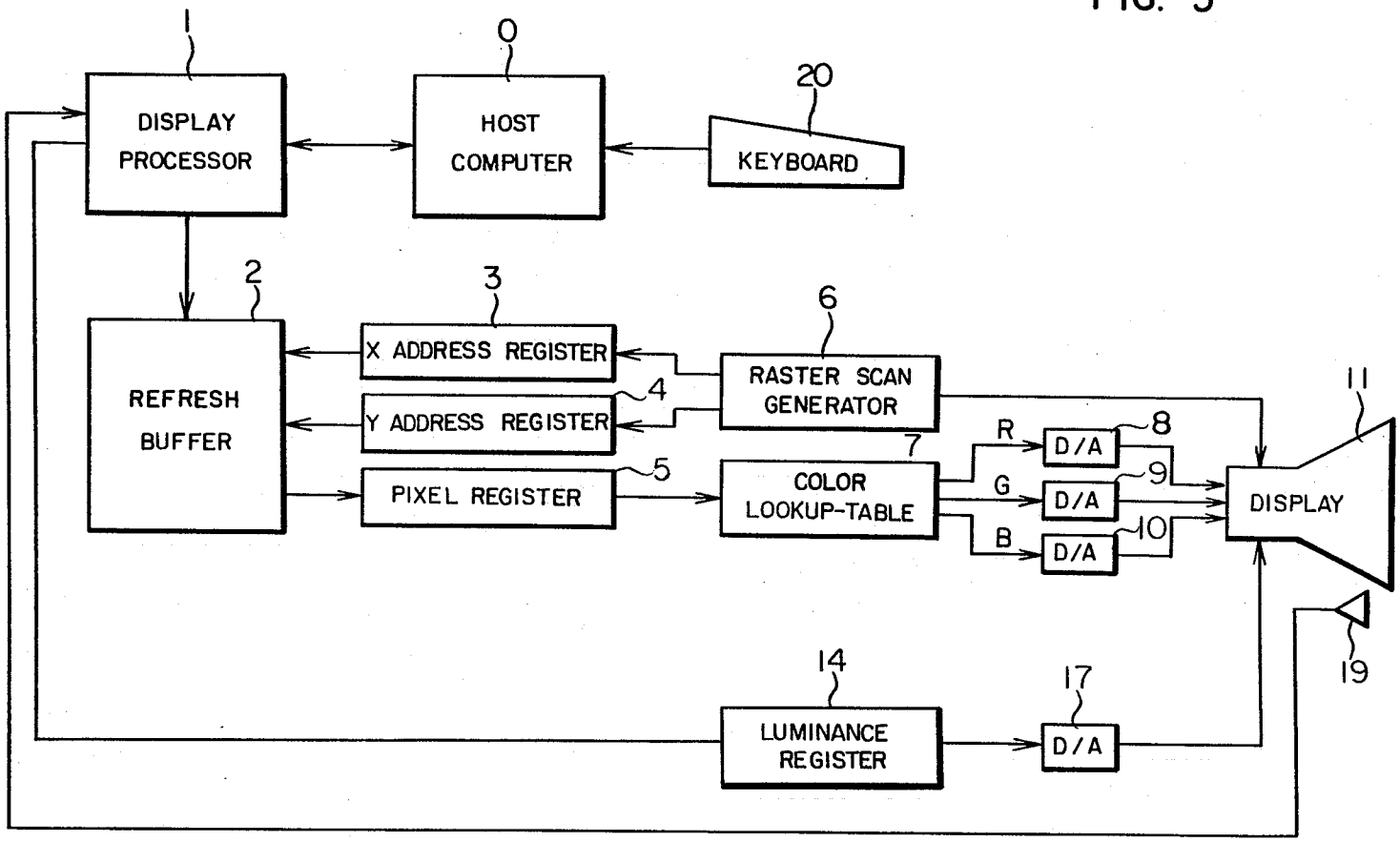
FIG. 5 is a circuit diagram showing a display system according to another embodiment of the present invention.

In the foregoing embodiment, the luminance of the display screen has been determined for each refresh cycle to dynamically control the luminance of the display screen in conformity with the surrounding condition. on the other hand, FIG. 5 shows another embodiment of the present invention in the case where the system cost is lowered and a precise luminance control is not required.

Referring to FIG. 5, the display processor 1 is generally constructed by a microprocessor. The microprocessor performs a predictive calculation of the luminance of display screen while reading the brightness of the interior of a room from the photo sensor 19. Thereafter, the microprocessor performs the same process as the embodiment shown in FIG. 1 to control the brightness of the display screen so that it is easy to see.

Figure 6:
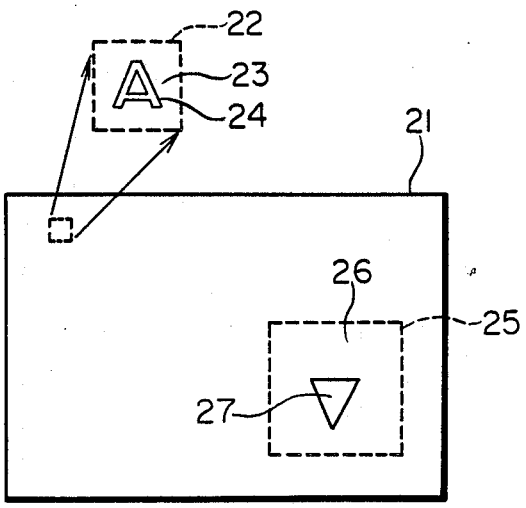
FIG. 6 is a view showing an example of a display screen in the embodiment shown in FIG. 5.

A method of calculating the luminance of the display screen in the embodiment shown in FIG. 5 will now be described by use of FIG. 6. Referring to FIG. 6, reference numeral 21 designates the display screen of the display unit 11. Characters and figures or the like are displayed on the display screen. For displaying such characters and figures, the host computer 0 defines a character region 22 and a figure region 25 and designates foreground and background colors (24 and 23 or 27 and 26) in each of those regions, and the display processor 1 develops those data into image data which in turn are stored in the refresh buffer 2. For that purpose, the display processor 1 makes a rough calculation of the luminance of the display screen in accordance with the following equation:

(luminance of display screen) = (number of characters to be displayed) + (luminance of foreground color of characters + luminance of background color of characters) + (luminance of background color of figure regions). (2)

Each time the contents to be displayed on the screen change, this calculation is performed so that the luminance of the display screen is controlled in accordance with a value obtained by the calculation.

As has been mentioned above, according to the present invention, the luminance of the screen of the display unit can be controlled to have an optimum brightness in conformity with the contents to be displayed on the screen. Accordingly, there is provided an effect that the fatigue of the user's eyes can be greatly reduced.

I claim:

1. A display system comprising:

image displaying means for displaying a predetermined image on a screen by a raster scan;

image data generating means or generating predetermined image data to be displayed by said image displaying means;

storing means fore storing information representative of said predetermined image data generated by said image data generating means; and image designating means for supplying said information stored in said storing means to said image displaying means in synchronism with said raster scan, said image designating means including luminance calculating means for calculating a value of luminance in accordance with contents of said information stored in said storing means and luminance controlling means for controlling luminance of said screen of said image displaying means in response to said calculated luminance value;

wherein said luminance calculating means adds luminance data to a sum of previous luminance data each time information for a pixel of said screen is read from said storing means, thereby calculating luminance of the screen for one image to be displayed by said image displaying means.

2. A display system according to claim 1, wherein said image designating means includes a color look-up table in which the values of luminance for respective pixels are stored.

3. A display system according to claim 2 wherein said luminance calculating means calculates the luminance $I_p$ for each pixel of information in accordance with an equation of $$I_p = K_r R_p + K_g G_p + K_b B_p$$

where $R_p$, $G_p$ and $B_p$ represent color data for pixel p and $K_r$, $K_g$ and $K_b$ represent coefficients.

4. A display system according to claim 1, wherein said luminance controlling means includes a reference table which indicates a control condition of luminance of an image to be displayed.

5. A display system according to claim 4, wherein said luminance controlling means detects the brightness of an interior of a room in which said image displaying means is placed, and establishes a luminance control condition on the basis of the value of the detected brightness.

6. A display system comprising:

image displaying means for displaying a predetermined image on a screen by a raster scan;

image data generating means for generating predetermined image data to be displayed by said image displaying means;

storing means for storing information representative of said predetermined image data generated by said image data generating means; and image designating means for supplying said information stored in said storing means to said image displaying means in synchronism with said raster scan, said image designating means including luminance calculating means for calculating a value of luminance in accordance with contents of said information stored in said storing means and luminance controlling means for controlling luminance of said screen of said image displaying means in response to said calculated luminance value;

wherein said luminance calculating means divides the screen of said image displaying means into a character region and a figure region, designated foreground and background colors of each of said character and figure regions, and determines the luminance of the display screen in accordance with an equation of (luminance of display screen)=(number of characters to be displayed)×(luminance of foreground color of characters+luminance of background color of characters)+(luminance of background color of figure region).

7. A display system according to claim 6, wherein said luminance controlling means includes a reference table which indicates a control condition of luminance of an image to be displayed.

8. A display system comprising;

a display unit for displaying display data;

a display processor for generating display data to be displayed on a screen of said display unit;

storing means for storing the display data to be displayed on the screen of said display unit;

means for reading the display stored in said storing means in synchronism with a raster scan of said display unit to display the display data on the screen of said display unit;

means for calculating a value of luminance of said display data stored in said storing means and displayed on the screen of said display unit; and means for dynamically controlling the luminance of the display screen on the basis of the value of luminance determined by said calculating means;

wherein said means for calculating adds luminance doa to a sum of previous luminance doa each time display data displayed on said screen is read from said storing means by said means for reading, thereby calculating luminance of said screen for one image to be displayed by said display unit.

9. A display system according to claim 8, furthe comprising:

a color look-up table connected between said storing means and said reading means, for converting said display data stored in said storing means to color display data which is supplied to said reading means, said look up table has stored therein quantities of primary red, green and blue colors representative of a color and an amount of luminance when the color is lightened on said display unit.

10. A display system according to claim 8, comprising a detector for detecting brightness of an interior of a room, and means applied with the detected value of brightness detected by said detector and a value of luminance of the screen of said display unit calculated by said calculating means, for controlling a luminance signal for said display unit.

11. A display system according to claim 8, further comprising:

means for establishing a control condition for dynamically controlling the luminance of the screen of said display unit, said established control condition being referred to by said dynamically controlling means.

* * * * *